United States Patent [19]

Wilhelm et al.

[11] Patent Number: 4,538,090

[45] Date of Patent: Aug. 27, 1985

[54] LAMP/REFLECTOR UNIT

[75] Inventors: Dieter Wilhelm, Eschweiler, Fed. Rep. of Germany; Volker Kuhnert, Kerkrade, Netherlands

[73] Assignee: U.S. Philips Corporation, New York, N.Y.

[21] Appl. No.: 46,581

[22] Filed: Jun. 7, 1979

[30] Foreign Application Priority Data

Jun. 12, 1978 [DE] Fed. Rep. of Germany ..... 2825666

[51] Int. Cl.[3] ..... H01J 5/16

[52] U.S. Cl. ..... 313/578; 313/580

[58] Field of Search ..... 313/222, 578–588

[56] References Cited

U.S. PATENT DOCUMENTS

| | | | |
|---|---|---|---|
| 3,441,778 | 4/1969 | Deiss | 313/222 X |
| 4,195,245 | 3/1980 | Miyazawa | 313/222 X |
| 4,241,391 | 12/1980 | Pitkjaan et al. | 313/222 X |

*Primary Examiner*—David K. Moore

*Attorney, Agent, or Firm*—Robert S. Smith

[57] ABSTRACT

The light bulb of a lamp/reflector unit is mounted in spaced relation to the reflecting surface of the reflector member by means of mounting clips which engage in a clamping manner around a respective narrow side face of the pinch seal of the light bulb. Support wires are secured to the mounting clips, with which wires the light bulb is suspended in the reflector member.

2 Claims, 3 Drawing Figures

LAMP/REFLECTOR UNIT

Figure 1:
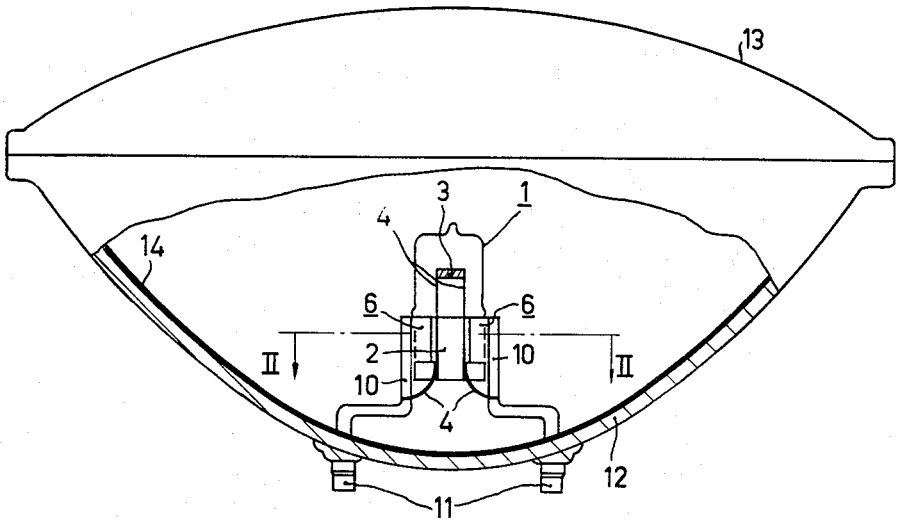

The invention relates to a lamp/reflector unit having a concave reflector member and a lens member attached thereto. A light bulb is supported in spaced relation to the reflecting surface of the reflector member, the light bulb has a pinch seal at one end thereof which is substantially rectangular in cross-section and from which current conductors extend which are in electrical contact with a filament disposed within the light bulb, each current conductor is attached to a respective support wire, the reflector member has mutually electrically insulated contact members, each of the support wires is attached to a respective contact member.

Such a lamp/reflector unit is known from U.S. Pat. No. 3,737,960. In the known unit the light bulb is held only by the welded joints between the support wires and the current conductors. Therefore, in the case of shocks and vibrations, the welded joints are exposed to varying mechanical loads which may result in interruption of the connections. The known construction requires the use of comparatively thick current conductors to ensure sufficient rigidity. In spite of this the construction imposes restrictions on the weight of the light bulb so as to prevent excessive swinging of the light bulb when the unit is exposed to shocks.

It is the object of the invention to provide a simple and rigid construction for the suspension of a light bulb in a reflector.

According to the invention, a lamp/reflector unit of the kind mentioned in the opening paragraph is characterized in that the pinch seal is secured between two opposed metal mounting clips each engaging in a clamping manner around a respective narrow side face of the pinch seal, each support wire being secured to a respective metal mounting clip.

In this lamp/reflector unit the connection of the current conductors to the support wires is not loaded mechanically. As a result of this no requirements need be imposed upon the rigidity of the current conductors. Moreover, the light bulb is supported by the support wires nearer to its center of gravity than if it were supported by its current conductors.

In one embodiment each metal mounting clip is generally U-shaped and is formed from a resilient metal strip, each side limb of the U sloping inwardly from the base of the U to a region where it engages a major surface of the pinch seal. The advantage of this is that wide tolerances may be permitted in the shape and the dimensions of the pinch seal of the light bulb.

In a special embodiment, the base of each U-shaped mounting clip is curved inwardly of the U-shape thereof. The advantage of this shape is that each mounting clip, after assembly on the pinch seal of the light bulb, is in contact the pinch seal along three lines. Also, even if the pinch seal is not exactly rectangular in cross section, for example trapezoidal, good positioning of the mounting clips on the pinch seal of the light bult is nevertheless obtained.

A particularly rigid construction is obtained if the support wires are fixed to the mounting element in at least two spaced places.

Embodiments of a lamp/reflector unit according to the invention are shown in the drawing. In the drawing FIG. 1 shows a lamp/reflector unit partly broken away, FIG. 2 is a cross-sectional view through the unit shown in FIG. 1 taken on the line II—II, and FIG. 3 is a modified embodiment of FIG. 2.

Figure 2:
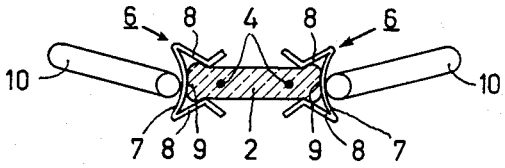
Figure 3:
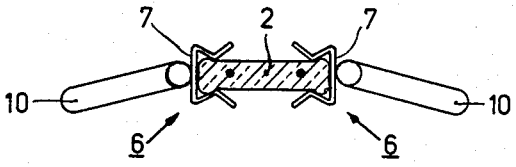

The unit shown in FIGS. 1 and 2 has a light bulb 1 having a quartz glass envelope filled with a halogen containing inert gas and provided with a pinch seal 2 which is substantially rectangular in cross-section. A filament 3, having current conductors 4 which emanate from the pinch seal 2, is provided in the light bulb 1.

Two U-shaped mounting clips 6 consisting, for example, of spring steel are clamped laterally on the pinch seal 2. The base 7 of each of the mounting clips 6 between the side limbs 8 is curved inwardly and has a central region 9 to which a cranked support wire 10 is fastened, for example by welding or soldering in two or more places. A respective one of the current conductors 4 is connected to each support wire 10.

In the cross-sectional view shown in FIG. 2 a particularly rigid three-region engagement is obtained between the mounting clips 6 and the clamped pinch seal 2, namely by the two regions of engagement of the limbs 8 and by the region 9. In practice the pinch seal 2 has enlarged ends, as shown, but these do not adversely affect the seating of the mounting clips 6 on the pinch seal due to the shape of said mounting clips 6.

As shown in FIG. 1, the ends of the support wires 10 remote from the mounting clips 6 are located in, and are soldered to, respective contact elements 11 in a reflector member 12 having a reflecting surface 14. In assembling the lamp/reflector unit, a lightbulb, e.g. a $H_2$ or $H_3$ motorcar high beam lamp, may be provided with mounting clips 6 and support wires 10 before said support wires are attached to a respective contact element 11. Alternatively, however at first the support wires 10 may be mounted in the reflector member 12 together with the mounting clips 6 connected thereto, after which the lamp with its pinch seal 2 is secured between the mounting clips 6 and the current conductors 4 are connected to the cranked support wires 10, for example by welding. A lens member 13 is provided afterwards on the reflector member 12 and the inside of the resulting outer envelope is filled with an inert gas.

The mounting clips 6 in FIG. 3 differ from those of FIG. 2 in that the base of the U of each mounting clip is not inwardly curved.

What is claimed is:

1. An automobile lamp/reflector unit having a concave reflector member and a lens member attached thereto for supporting an associated light bulb in spaced relation to the reflecting surface of said reflector member, the associated light bulb having a pinch seal at one end thereof which is substantially rectangular in cross-section and from which current conductors extend which are in electrical contact with a filament disposed within the light bulb, each of said current conductors being attached to a respective support wire, said reflector member having at least two mutually electrically insulated contact members, each of said support wires being attached to respective contact members, characterized in that the pinch seal is secured between two opposed metal mounting clips, each clip engaging in a clamping manner around a respective narrow side face of the pinch seal, each support wire being secured to a respective metal mounting clip, each clip being generally U-shaped and having side limbs and a base and being formed from a resilient metal strip, each of said side limbs of said clip sloping inwardly from the base of the U to a region where they engage a respective major surface of the pinch seal.

2. An automobile lamp/reflector unit having a concave reflector member and a lens member attached thereto for supporting an associated light bulb in spaced relation to the reflecting surface of said reflector member, the associated light bulb having a pinch seal at one end thereof which is substantially rectangular in cross-section and from which current conductors extend which are in electrical contact with a filament disposed within the light bulb, each of said current conductors being attached to a respective support wire, said reflector member having at least two mutually electrically insulated contact members, each of said support wires being attached to respective contact members, characterized in that the pinch seal is secured between two opposed metal mounting clips, each clip engaging in a clamping manner around a respective narrow side face of the pinch seal, each support wire being secured to a respective metal mounting clip, each clip being generally U-shaped and having side limbs and a base and being formed from a resilient metal strip, each of said side limbs of said clip sloping inwardly from the base of the U to a region where they engage a respective major surface of the pinch seal, said base of each U-shaped mounting clip being curved inwardly of the U and said base of each mounting clip being dimensioned and configured for engaging a respective narrow side face of the pinch seal of an associated light bulb.

* * * * *